US006328607B1

(12) United States Patent
Wang

(10) Patent No.: US 6,328,607 B1
(45) Date of Patent: Dec. 11, 2001

(54) VIBRATOR CONNECTOR

(75) Inventor: Chris Wang, Hsinchu (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 09/852,088

(22) Filed: May 10, 2001

(30) Foreign Application Priority Data

Jun. 22, 2000 (TW) ..... 089210718

(51) Int. Cl.[7] ..... H01R 33/00
(52) U.S. Cl. ..... 439/660; 379/429
(58) Field of Search ..... 439/660, 74, 66, 439/81, 83, 76.1; 379/429, 428; 455/566

(56) References Cited

U.S. PATENT DOCUMENTS 5,749,737 * 5/1998 Zuin ..... 439/500
6,068,517 * 5/2000 Tanaka ..... 439/660

* cited by examiner

*Primary Examiner*—Renee Luebke
*Assistant Examiner*—Briggitte R. Hammond
(74) *Attorney, Agent, or Firm*—Bacon & Thomas, PLLC

(57) ABSTRACT

A vibrator connector adapted to connect a vibrator to a circuit board, including an electrically insulative shell mounted on the circuit board, the shell having two parallel terminal slots extended in reversed directions and a top stop wall spaced above the terminal slots, and two terminals mounted in the terminal slots inside the shell, the terminals each having a connecting plate soldered to the circuit board, a curved springy extension arm stopped below the top stop wall of the shell and terminating in a contact portion suspending above the top stop wall of the shell and disposed in contact with a respective contact of the vibrator.

10 Claims, 7 Drawing Sheets

VIBRATOR CONNECTOR

BACKGROUND OF THE INVENTION

The present invention relates to electric connectors and, more particularly, to a vibrator connector adapted to connect a vibrator to a circuit board.

Following fast development of telecommunication technology, a variety of mobile telephones have been disclosed, and are intensively used for communication for the advantage of high mobility. Modern mobile telephones are commonly equipped with a vibrator to provide a silent mode. When receiving a message under the silent mode, the vibrator is triggered to vibrate, informing the user of the incoming of the message. The vibrator is connected to a circuit board through a vibrator connector. FIGS. 8 and 9 show a vibrator connector according to the prior art. This structure of vibrator connector comprises an electrically insulative shell B, and two terminals A respectively mounted in the shell B. The shell B comprises two terminal slots B1, and two stop edges B11 respective disposed in the terminal slots B1. The terminals A are respectively mounted in the terminal slots B1, each comprising a contact arm A3, a stop face A31 stopped against one stop edge B11 of the shell B, a receptacle portion A4, a connecting portion A1 connected to the circuit board, and a retaining strip A2 secured to the peripheral wall of the respective terminal slot B1. The vibrator C has lead wires connected to a matching connector comprised of an electrically insulative shell D, which is coupled to the shell B, and two terminals D1, which are respectively fastened to the receptacle portion A4 of each of the terminals A. This structure of vibrator connector has drawbacks. Because a matching connector D;D1 must be used with the vibrator connector to connect the vibrator C to the circuit board, the installation cost of the vibrator C is high. Further after insertion of the terminals A in the terminal slots B1 of the shell B, a special tool must be used to bent the retaining strip A2, enabling the retaining strip A2 to be secured to the respective terminal slot B1.

SUMMARY OF THE INVENTION

The present invention has been accomplished to provide a vibrator connector, which eliminates the aforesaid drawbacks. According to one aspect of the present invention, the vibrator connector comprises an electrically insulative shell mounted on the circuit board, the shell having two parallel terminal slots extended in reversed directions and a top stop wall spaced above the terminal slots, and two terminals mounted in the terminal slots inside the shell, the terminals each having a connecting plate soldered to the circuit board, a curved springy extension arm stopped below the top stop wall of the shell and terminating in a contact portion suspending above the top stop wall of the shell and disposed in contact with a respective contact of the vibrator. According to another aspect of the present invention, the electrically insulative shell comprises two retaining notches respectively disposed in the terminal slots at one side, and the terminals each comprise a stop tooth obliquely backwardly extended from the respective mounting base and respectively engaged into the retaining notch in each of the terminal slots of the electrically insulative shell.

DETAILED DESCRIPTION OF THE PREFERRED EMBODIMENT

Figure 1:
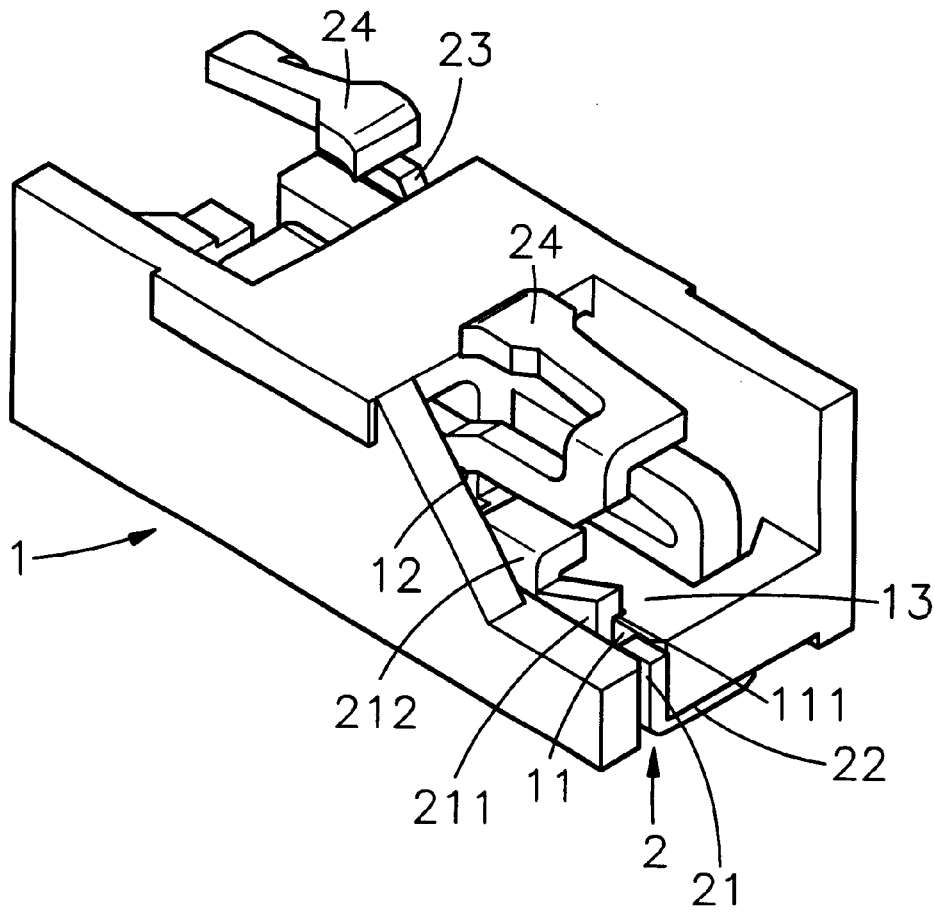
FIG. 1 is an elevational view of a vibrator connector according to the present invention.
Figure 2:
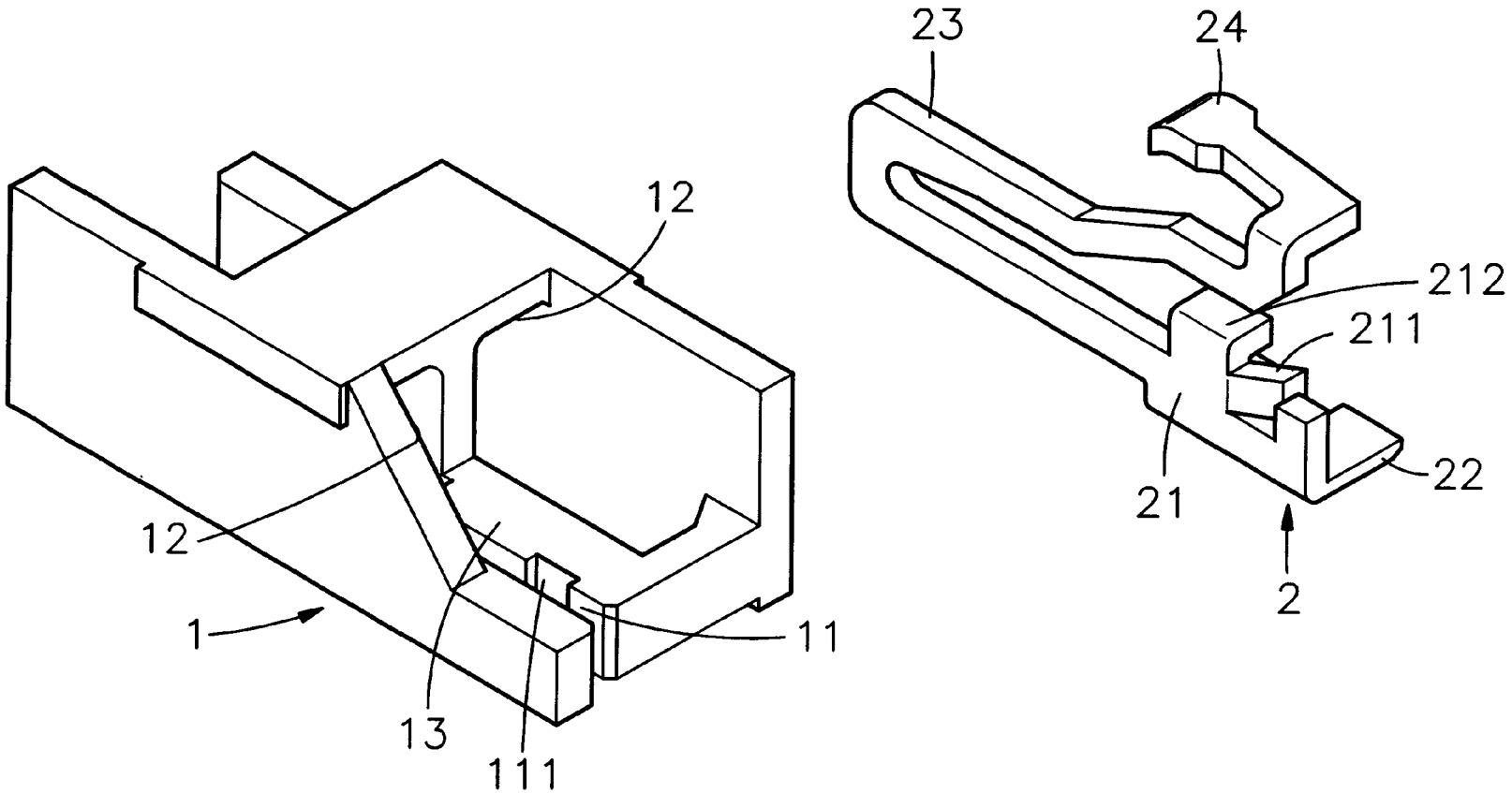
FIG. 2 is an exploded view of the vibrator connector according to the present invention.

Referring to FIGS. 1 and 2, a vibrator connector in accordance with the present invention is shown comprised of an electrically insulative shell 1, and two terminals 2. The shell 1 comprises two parallel terminal slots 11 longitudinally extended in reversed directions at the bottom side, two retaining notches 111 respectively disposed in the terminal slots 11 at one side, a top stop wall 12 transversely disposed at the top side on the middle, and a partition plate 13 disposed between the terminal slots 11. The terminals 2 are made of springy metal plate, each comprising a mounting base 21, a stop tooth 211 obliquely backwardly extended from the mounting base 21, a hook plate 212 extended sideways from the top side of the mounting base 21 at one side, a connecting plate 22 extended sideways from the bottom side of the mounting base 21 at one side below the hook plate 212 for connection to the circuit board 3 (see also FIG. 6), and a curved springy extension arm 23 forwardly extended from the front side of the mounting base 21 and terminating in a horizontal contact portion 24 for contacting a respective contact 41 of the vibrator 4 (see also FIG. 7). The curved springy extension arm 23 can be made having a substantially ⊏-shaped profile, Z-shaped profile, or S-shaped profile.

Figure 3:
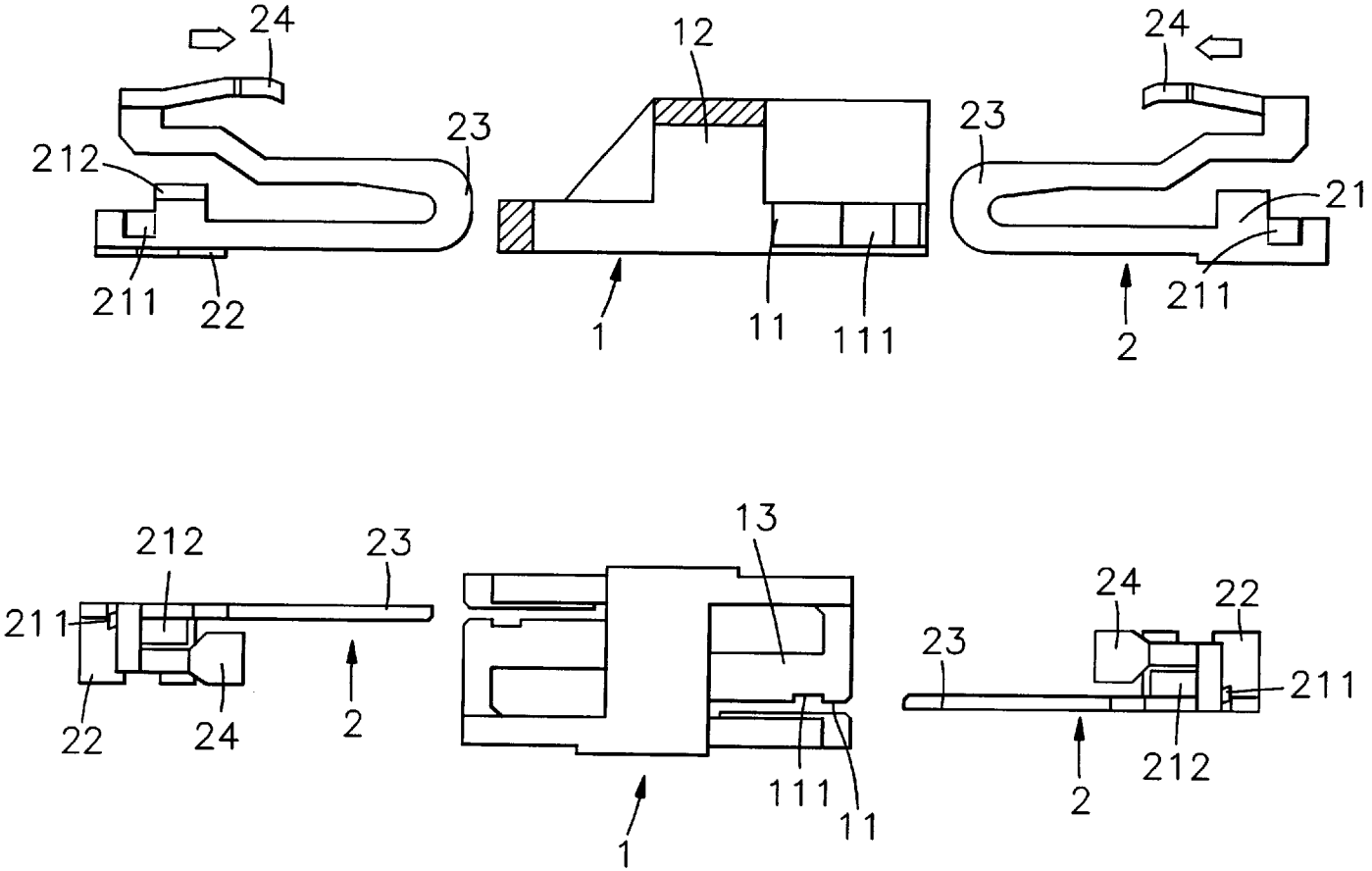
FIG. 3 is side and top plain views of the vibrator connector according to the present invention before the assembly procedure.
Figure 4:
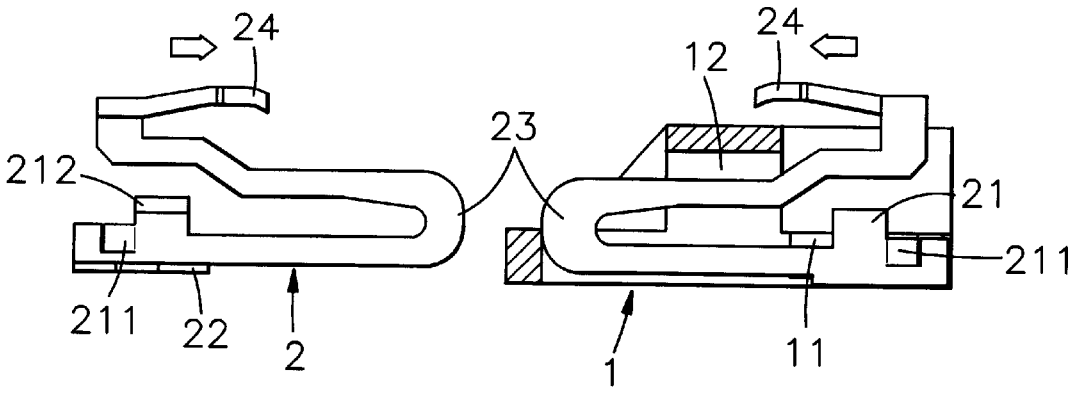
FIG. 4 is a side view showing one terminal inserted into the electrically insulative shell according to the present invention.
Figure 5:
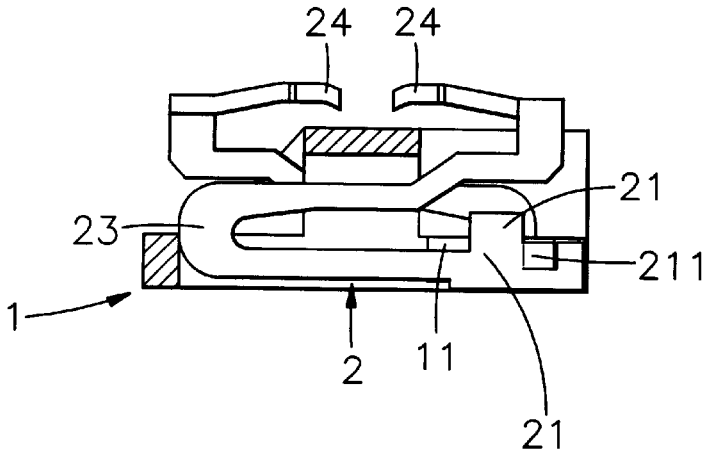
FIG. 5 is a side view showing the two terminals installed in the electrically insulative shell according to the present invention.

The assembly process of the vibrator connector is outlined hereinafter with reference to FIGS. from 3 through 5. The curved springy extension arm 23 of one terminal 2 is inserted into one terminal slot 11 of the shell 1 and passed over the bottom side of the top stop wall 12 (see FIG. 3) to force the stop tooth 211 into engagement with the retaining notch 111 in the respective terminal slot 11, enabling the hook plate 212 and the connecting plate 22 to be respectively attached to the top and bottom sides of the partition plate 13 (see FIG. 4), and then the other terminal 2 is positioned in the other terminal slot 11 (see FIG. 5). When assembled, the horizontal contact portion 24 of the curved springy extension arm 23 of each terminal 2 is suspending in the open air above the top stop wall 12, and can be moved up and down.

Figure 6:
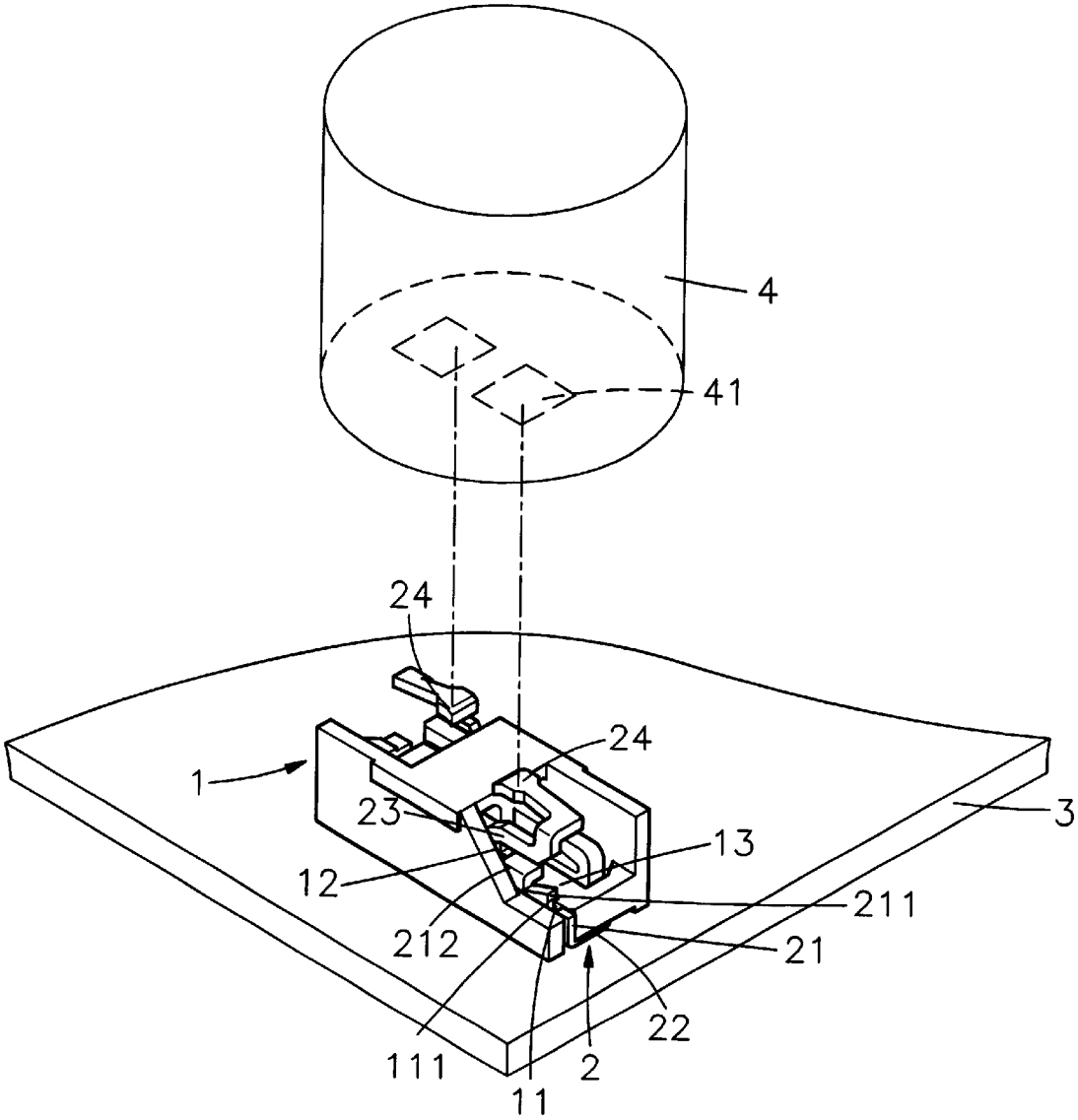
FIG. 6 is an installed view of the present invention showing the vibrator connector installed in the circuit board before installation of the vibrator.
Figure 7:
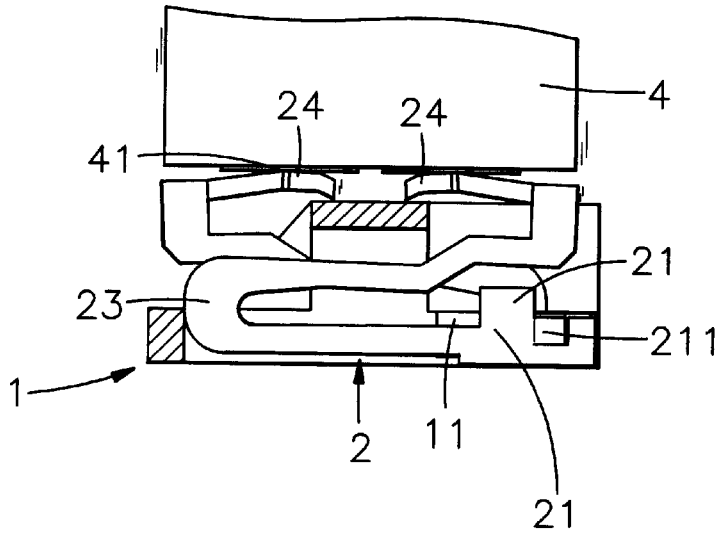
FIG. 7 is a side plain view showing the horizontal contact portion of each terminal respectively disposed in contact with the, respective contact of the vibrator.
Figure 8:
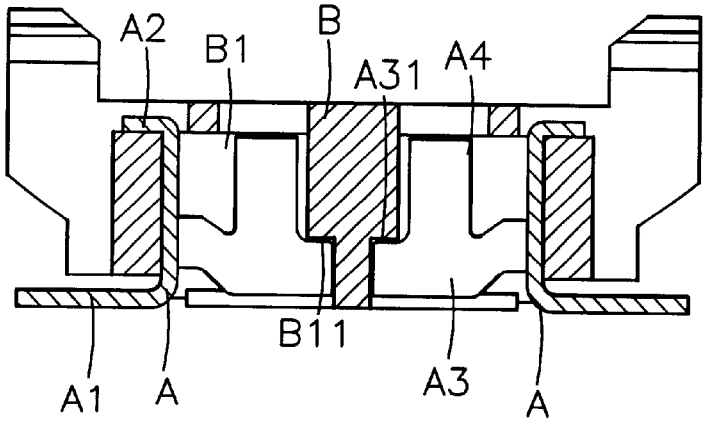
PRIOR ART FIG. 8
FIG. 8 is a sectional view of a vibrator connector according to the prior art.
Figure 9:
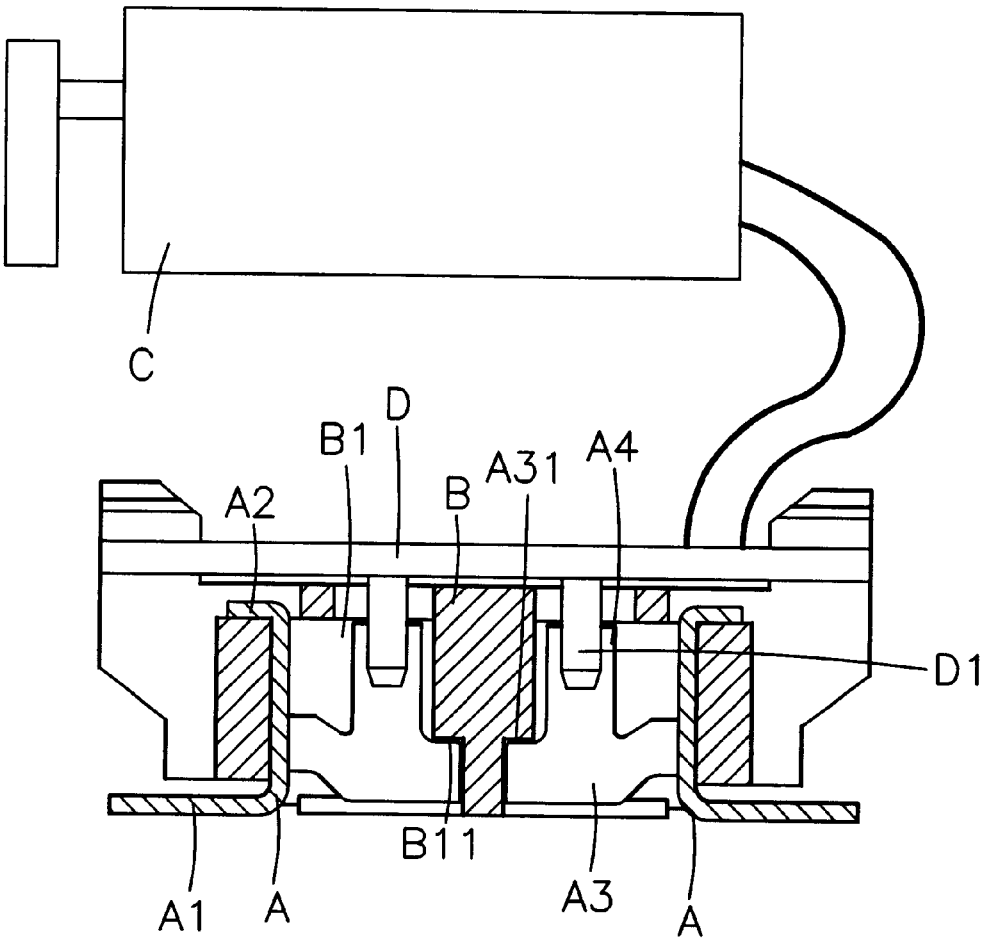
PRIOR ART FIG. 9
FIG. 9 is an installed view showing the prior art vibrator connector installed in a circuit board and connected to a vibrator.

Referring to FIGS. 6 and 7, during installation, the connecting plate 22 of each terminal 2 is respectively soldered to the circuit board 3 by surface mounting technology, and the horizontal contact portion 24 of each terminal 2 is respectively pressed on the respective contact 41 of the vibrator 4. When triggering the vibrator 4, the curved springy extension arm 23 of each terminal 2 is oscillated with the vibrator 4, keeping the horizontal contact portion 24 of each terminal 2 constantly maintained in close contact with the respective contact 41 of the vibrator 4.

As indicated above, when inserting the terminal 2 into one terminal slot 11 of the shell 1, the stop tooth 211 is automatically forced into engagement with the retaining notch 111 in the respective terminal slot 11 to hold the terminal 2 in position. Therefore, the assembly process of the vibrator connector is simple. In the aforesaid preferred embodiment of the present invention, the terminals 2 are fastened to the circuit board 3 by surface mounting technology. Alternatively, through hole mounting technique can also be employed to the present invention.

As indicated above, the vibrator connector has following features:

1. Because the curved springy extension arm of each terminal is directly disposed in contact with the respective contact of the vibrator and moved with the vibration of the vibrator, no additional connector means is needed to connect the vibrator to the vibrator connector.
2. Each terminal has a stop tooth and a hook plate for positioning in the respective terminal slot of the shell positively.
3. Because the terminals are automatically set into position and maintained in contact with the respective contacts of the vibrator when inserted into the respective terminal slots of the shell, the installation of the vibrator connector is simple and timesaving.

A prototype of vibrator connector has been constructed with the features of the annexed drawings. The vibrator connector functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A vibrator connector connecting a vibrator to a circuit board, said connector comprising an electrically insulative shell mounted on the circuit board, said electrically insulative shell comprising two parallel terminal slots, and two terminals mounted in said electrically insulative shell and connected between the circuit board and the vibrator, said terminals each comprising a mounting base respectively mounted in said terminal slots of said electrically insulative shell and soldered to the circuit board, wherein said electrically insulative shell comprises a top stop wall transversely disposed at a top side and spaced above said terminal slots; said terminals each comprise a curved springy extension arm extended from a front side of the respective mounting base and stopped below said top stop wall of said electrically insulative shell, said curved springy extension arm having a tail end extended out of said electrically insulative shell and terminating in a contact portion suspending above said top stop wall of said electrically insulative shell and disposed in contact with a respective contact of the vibrator.

2. The vibrator connector of claim 1 wherein said electrically insulative shell comprises two retaining notches respectively disposed in said terminal slots at one side, and said terminals each comprise a stop tooth obliquely backwardly extended from the respective mounting base and respectively engaged into the retaining notch in each of the terminal slots of said electrically insulative shell.

3. The vibrator connector of claim 1 wherein the horizontal contact portion of each of said terminals is respectively soldered to the respective contact of the vibrator.

4. The vibrator connector of claim 1 wherein the extension springy arm of each of said terminals has a ⊏-shaped profile.

5. The vibrator connector of claim 1 wherein the extension springy arm of each of said terminals has a Z-shaped profile.

6. The vibrator connector of claim 1 wherein the extension springy arm of each of said terminals has a S-shaped profile.

7. The vibrator connector of claim 1 wherein the contact portion of the extension springy arm of each of said terminals has a transversely extended horizontal surface connected to the respective contact of the vibrator by surface mounting technology.

8. The vibrator connector of claim 1 wherein said terminal slots of said electrically insulative shell are reversely extended to two opposite ends of a bottom sidewall of said electrically insulative shell.

9. The vibrator connector of claim 1 wherein said electrically insulative shell comprises a partition plate separating said terminal slots, and said terminals each comprise a hook plate extended sideways from the respective mounting base and hooked on said partition plate of said electrically insulative shell.

10. The vibrator connector of claim 9 wherein said terminals each comprise a connecting plate extended sideways from the respective mounting base below said hook plate and stopped at a bottom side of said partition plate and soldered to the circuit board.

* * * * *